United States Patent [19]

Bell

[11] 4,252,215

[45] Feb. 24, 1981

[54] RESCUE DEVICE

[76] Inventor: Michael Bell, P.O. Box 400, Warrington, Pa. 18976

[21] Appl. No.: 88,330

[22] Filed: Oct. 25, 1979

[51] Int. Cl.[3] ..... B66F 11/04; A63J 5/12; B66B 1/00

[52] U.S. Cl. ..... 182/46; 182/2; 182/141; 254/93 HD

[58] Field of Search ..... 182/2, 46, 141, 148, 182/230; 254/93 HP

[56] References Cited

U.S. PATENT DOCUMENTS

| | | | |
|---|---|---|---|
| 2,609,177 | 9/1952 | Hughes | 254/93 HP |
| 2,725,578 | 12/1955 | Keller | 254/93 HP |
| 3,050,152 | 8/1962 | Blain | 182/141 |
| 3,311,930 | 4/1967 | Bourke | 297/DIG. 3 |
| 3,479,087 | 11/1969 | Burke | 297/DIG. 10 |
| 3,625,305 | 12/1971 | Mueller | 182/2 |
| 3,642,096 | 2/1972 | Valentine | 182/2 |
| 3,670,849 | 6/1972 | Milner | 182/2 |
| 3,967,360 | 7/1976 | Nolte | 254/93 HP |
| 4,102,373 | 7/1978 | Winiasz | 254/93 HP |

*Primary Examiner*—Reinaldo P. Machado
*Attorney, Agent, or Firm*—Caesar, Rivise, Bernstein & Cohen, Ltd.

[57] ABSTRACT

A rescue device for use in combination with a hollow basket used to support a workman. The hollow basket includes a floor and an upwardly projecting peripheral sidewall. The upper edge of the sidewall forms an open mouth for the basket to enable a workman to stand within the basket. The rescue device is arranged to raise the workman out of the basket in the event that the workman becomes incapacitated and comprises an inflatable bag having a top and bottom surface, a rigid plate mounted on the top surface and a flexible tube connected to and communicating with the bag. The bag is disposed in the basket so that its bottom surface is on the floor. The plate encompasses the full area of the floor of the basket. The tube extends upward along the sidewall of the basket so that its free end is located adjacent the mouth of the basket for connection to a supply of gas for inflating the bag to cause the plate to move upward toward the mouth of the basket, thereby raising the workman.

8 Claims, 4 Drawing Figures

FIG. 1
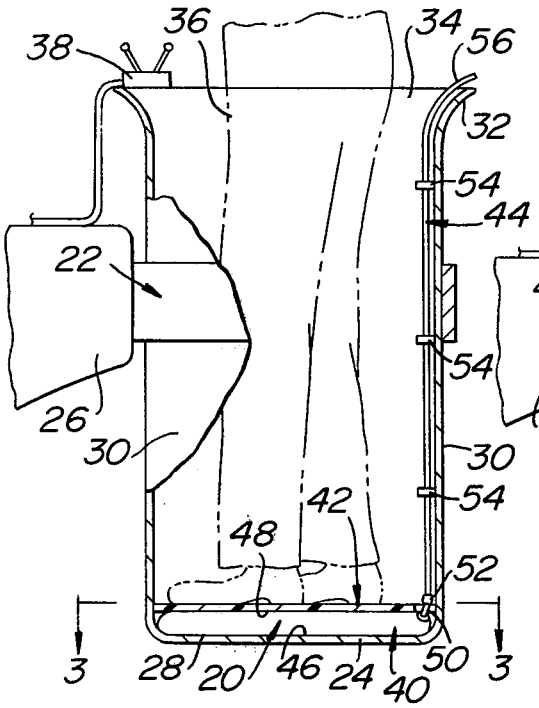
FIG. 2
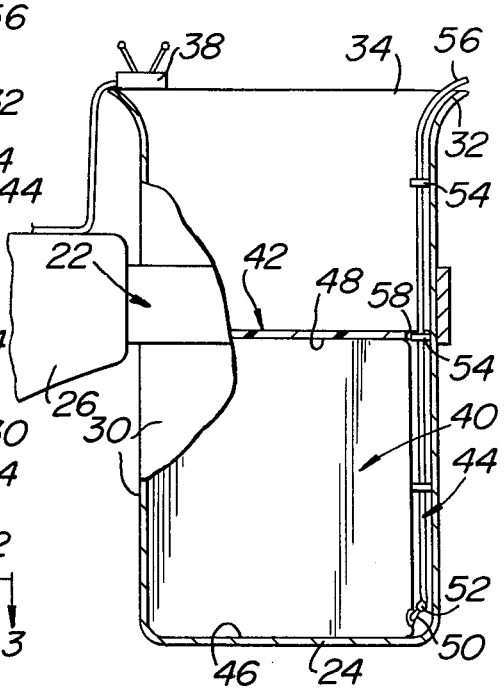
FIG. 3
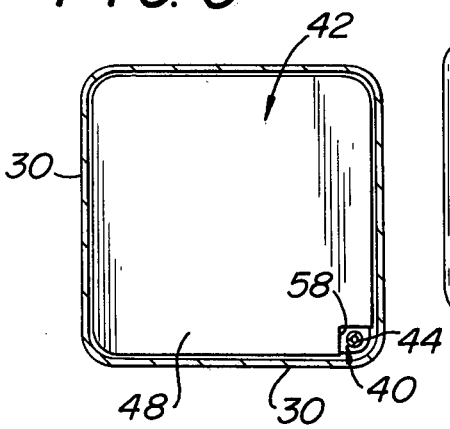
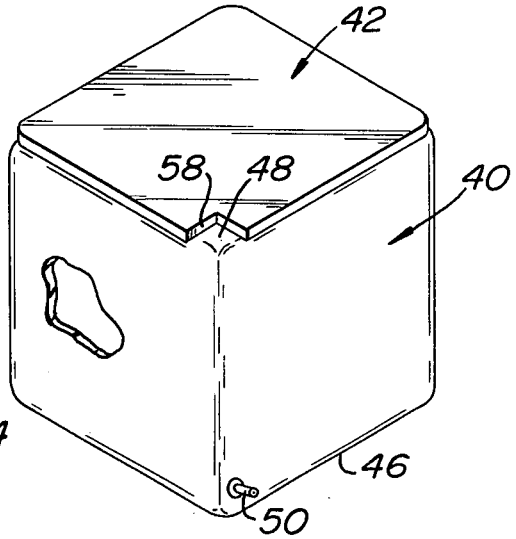
FIG. 4

RESCUE DEVICE

This invention relates generally to rescue devices and more particularly to devices for use in elevated baskets or platforms.

Various work stations include baskets or buckets mounted on an elevatable boom or tower to raise the workman to an elevated position. Such devices are commonly known as "cherry pickers". The baskets of many commercially available "cherry pickers" are extremely compact, e.g., 21" inches (53.3 cm) by 21 inches (53.3 cm) in the interest of mobility. While such compact baskets usually provide sufficient room for a workman to stand and maneuver, if the workman should collapse or fall in the basket and become incapacitated, the cramped surroundings make his extradition extremely difficult. Thus, the need exists for a rescue device capable of quickly raising a workman out of a confined basket.

Accordingly, it is the general object of the instant invention to provide a rescue device which facilitates removal of a workman from a confined basket or bucket.

It is a further object of the instant invention to provide a rescue device which is simple in construction, yet effective for the removal of an incapacitated workman from a confined basket or bucket.

It is still a further object of the instant invention to provide a rescue device which is extremely compact so that it can be permanant located within a confined basket or bucket without taking up significant space therein.

These and other objects of the instant invention are achieved by providing for use in combination with a hollow basket having a floor and an upstanding peripheral sidewall defining a mouth for supporting a workman therein, a rescue device for expeditating the removal of the workman from the basket. The rescue device comprises an inflatable bag having a top and bottom surface, base means and conduit means. The bag is disposed in the basket with its bottom surface on the floor of the basket and with the base being located on the upper surface. The base is substantially more rigid than the bag and encompasses virtually the entire floor area of the basket. The conduit means communicates with the interior of the bag means and includes a free end disposed adjacent the mouth of the basket arranged for connection to a supply of fluid for inflating the bag to carry the base upward toward the mouth of the basket.

Other objects and many of the attendant advantages of this invention will be readily appreciated as the same becomes better understood by reference to the following detailed description when considered in connection with the accompaying drawing wherein:

FIG. 1 is a side elevational view, partially in section, of a conventional elevated basket including the rescue device of the instant invention;

FIG. 2 is a side elevational view, like that as shown in FIG. 1 but showing the rescue device after operation thereof;

FIG. 3 is a sectional view taken along line 3 of FIG. 1; and

FIG. 4 is a perspective view of a portion of the rescue device shown in FIG. 2.

Referring now to various figures of the drawing wherein like reference characters refer to like parts, there is shown at 20 in FIG. 1 a rescue device in accordance with the instant invention mounted within the work personnel holding portion of a conventional elevatable work station 22, e.g., "cherry picker". To that end the workstation is a basket or bucket 24 mounted on the free end 26 of an elevatable boom or tower. The basket 24 is a hollow member and includes a floor 28, of relatively compact dimension, e.g., 21"×21", having a sidewall 30 projecting upward about the periphery thereof. The upper edge 32 of the sidewall forms the mouth 34 of the basket.

The basket is arranged to hold a standing workman 36 to raise and lower the workman to any elevated position for accomplishing a particular task. The movement of the basket to an elevated position is normally accomplished under the control of the workman himself, via the use of hand controls 38 located within the basket adjacent its mouth.

While the basket's interior provides sufficient room for a workman to stand and to maneuver slightly, e.g., turn around to face any direction etc., it is nevertheless somewhat confining. Accordingly, in the event that the workman collapses, or falls, such as may occur in the event he has a heart attack, seizure or sustains an electrical shock, the cramped space within the basket makes it extremely difficult to remove the workman to provide medical attention.

The rescue device 20 of the instant invention is arranged for permanent disposition within the basket to be available as needed to rescue an incapacitated workman by raising him out of the basket.

The rescue device 20 basically comprises inflatable bag means 40, relatively rigid base means 42, and conduit means 44. The inflatable bag means 40 is formed of an air-impervious material, such as rubber, vinyl, laminated cloth, etc., and includes a bottom wall portion 46 and a top wall portion 48. The bag 40 is inflatable and is configured so that when inflated, it fills the lower portion of the interior of the basket with its top surface 48 approximately two feet (61 cm) above the basket's floor.

It must be pointed out at this juncture that the bag 40 when inflated need not assume the generally cubic shape shown in FIG. 4 but can be constructed to assume any convenient shape as long as its top surface 48 is substantially elevated about the floor 28 of the basket. The advantage of the shape shown in FIG. 4 is that it provides a relatively planar top surface 48 for supporting the planar base 42.

The base 42 is relatively rigid plate-like member, having the same overall configuration and size as that of the basket floor. The base plate 42 may be formed of any suitable material, such as fiberglass. The base 42 is disposed upon the top surface 48 of the inflatable bag 40. Since as the bag 40 is disposed on the floor 28 of the basket and with the planar base 42 on the top surface of the bag, the base 42 now serves as the workman supporting floor for the basket when the rescue device 20 is in place.

Normally, the bag 40 is deflated and compacted under the base so that the rescue device 20 does not take up appreciable room within the basket.

The bag 40 includes a gas port or coupling 50 located at one side of the bag. The coupling 50 includes a central passageway which communicates with the interior of the bag. The coupling 50 serves as the inlet for fluid, gas, e.g., to the bag 40 to inflate the bag. The conduit 44 is a flexible, tubular member having an open lower end 52 adapted to receive the coupling 50 therein so that the interior of the bag communicates with the interior of the conduit. The conduit extends upward along the basket sidewall 30 and is held in place, on the sidewall via a plurality of clips 54 or other suitable fastening means. The upper end of the conduit 44, designated by the reference numeral 56, is located adjacent the top edge 32 of the basket's sidewall for connection to means, not shown, for supplying gas, e.g., compresses air, etc., to inflate the bag.

Operation of the rescue device 20 is as follows: the device 20 is permanently located within the basket, as described heretofore, so that the workman 36 stands on the base 42, with the bag 40 compressed therebelow. In such an arrangement very little interior space within the basket is taken up by the device 20. In the event that the workman should collapse so that his body fills the interior of the basket, thereby making his extradition difficult, a source of fluid, e.g., compressed air, is attached to the free end 56 of the conduit 44. The fluid flows through the conduit, via coupling 50, into the interior of the bag 40 and inflates the bag. This action carries the base, and hence the workman, upward out of the basket. Once the extradition of the workman is complete, the bag is deflated and the base forced down to collapse the bag to restore the device to its ready condition.

As will be appreciated from the foregoing, the rescue device of the instant invention is of extreme utility of virtue of its permanent location within the interior of an elevated basket and ready for immediate operation in the event of an emergency. Owing to its compact nature, when positioned in the basket it does not take up appreciable space which would restrict movement of a workman. Moreover, the device is quite simple in construction and low in cost and does not require a retrofit of existing conventional elevatable baskets, thereby rendering it suitable for widespread use.

Without further elaboration, the foregoing will so fully illustrate my invention that others may, by applying current or knowledge, readily adapt the same for use under various conditions of service.

What is claimed as the invention is:

1. A rescue device for use in combination with a hollow basket having a floor and an upwardly projecting peripheral sidewall whose upper edge forms an open mouth for said basket, said basket being arranged to support a workman therein, said rescue device being arranged to raise the workman out of said basket and comprising inflatable bag means having a top and bottom surface, base means and conduit means, said bag being disposed in said basket with its bottom surface on said floor, said base means being substantially more rigid than said bag means and being disposed on the top surface thereof, said base means being arranged for supporting the workman thereon, said conduit means communicating with the interior of said bag means and having a free end disposed adjacent the mouth of said basket and arranged for connection to a supply of fluid for inflating said bag to cause said base means to move upward toward the mouth of said basket.

2. The rescue device of claim 1 wherein said base means comprises a support which is substantially more rigid than said bag means.

3. The rescue device of claim 2 wherein said base means comprises a rigid plate.

4. The rescue device of claim 3 wherein said rigid plate is contigued to encompass substantially the full area of said floor.

5. The rescue device of claim 4 wherein said bag is constructed so that when inflated via said conduit means, said bag encompasses substantially the full area of said floor.

6. The rescue device of claim 5 wherein said conduit means comprises a flexible tube.

7. The rescue device of claim 6 additionally comprising means for securing said flexible tube to the sidewall of said basket.

8. The rescue device of claim 7 wherein said plate is formed of fiberglass.

* * * * *